US008628630B2

(12) United States Patent
Kobayashi et al.

(10) Patent No.: US 8,628,630 B2
(45) Date of Patent: Jan. 14, 2014

(54) HOT-PRESSED STEEL SHEET MEMBER, STEEL SHEET FOR HOT-PRESS, AND METHOD FOR MANUFACTURING HOT-PRESSED STEEL SHEET MEMBER

(75) Inventors: Akio Kobayashi, Chiba (JP); Yoshimasa Funakawa, Chiba (JP); Kazuhiro Seto, Chiba (JP); Nobuyuki Kageyama, Chiba (JP); Tetsuo Yamamoto, Kanagawa (JP); Toru Hoshi, Chiba (JP); Takeshi Yokota, Chiba (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 13/390,198

(22) PCT Filed: Aug. 19, 2010

(86) PCT No.: PCT/JP2010/064432

§ 371 (c)(1),
(2), (4) Date: May 16, 2012

(87) PCT Pub. No.: WO2011/021724

PCT Pub. Date: Feb. 24, 2011

(65) Prior Publication Data

US 2012/0216925 A1 Aug. 30, 2012

(30) Foreign Application Priority Data

Aug. 21, 2009 (JP) ..... 2009-191573
Aug. 5, 2010 (JP) ..... 2010-175850

(51) Int. Cl.

| | |
|---|---|
| ***C22C 38/02*** | (2006.01) |
| ***C22C 38/04*** | (2006.01) |
| ***C22C 38/18*** | (2006.01) |
| ***C22C 38/40*** | (2006.01) |
| ***C21D 8/02*** | (2006.01) |
| ***C21D 8/04*** | (2006.01) |

(52) U.S. Cl.
USPC ..... 148/320; 148/333; 148/334; 148/335; 148/336; 148/654; 148/649

(58) Field of Classification Search
USPC ..... 148/320, 333–336, 649, 654; 420/104–128, 84
See application file for complete search history.

(56) References Cited

FOREIGN PATENT DOCUMENTS

| | | | |
|---|---|---|---|
| GB | 1 490 535 | | 11/1977 |
| JP | 2004-025247 | A | 1/2004 |
| JP | 2005-097725 | A | 4/2005 |
| JP | 2005-139485 | * | 6/2005 |
| JP | 2005-139485 | A | 6/2005 |

OTHER PUBLICATIONS

Machine-English translation of Japanese patent 2005-139485, Kusumi Kazuhisa, Jun. 2, 2005.*

* cited by examiner

*Primary Examiner* — Deborah Yee
(74) *Attorney, Agent, or Firm* — DLA Piper LLP (US)

(57) ABSTRACT

A hot-pressed steel sheet member has a composition containing, by mass, C: 0.09% to 0.38%, Si: 0.05% to 2.0%, Mn: 0.5% to 3.0%, P: 0.05% or less, S: 0.05% or less, Al: 0.005% to 0.1%, N: 0.01% or less, Sb: 0.002% to 0.03%, and the balance being Fe and inevitable impurities, and having a tensile strength TS of 980 to 2,130 MPa.

20 Claims, No Drawings

HOT-PRESSED STEEL SHEET MEMBER, STEEL SHEET FOR HOT-PRESS, AND METHOD FOR MANUFACTURING HOT-PRESSED STEEL SHEET MEMBER

RELATED APPLICATIONS

This is a §371 of International Application No. PCT/JP2010/064432, with an international filing date of Aug. 19, 2010, which is based on Japanese Patent Application Nos. 2009-191573, filed Aug. 21, 2009, and 2010-175850, filed Aug. 5, 2010, the subject matter of which is incorporated by reference.

TECHNICAL FIELD

This disclosure relates to a hot-pressed steel sheet member, the strength of which is increased by working a steel sheet heated in a metal mold including a die and punch and simultaneously rapidly cooling the steel sheet. In particular, this disclosure relates to a hot-pressed steel sheet member which has a tensile strength TS of 980 to 2,130 MPa and in which a decrease in a surface hardness is small, a steel sheet for hot-press, and a method for manufacturing the hot-pressed steel sheet member.

BACKGROUND

Hitherto, structural members used in automobiles and the like have been manufactured by press-working a steel sheet having a desired strength. Recently, on the basis of a requirement for a reduction in the weight of automobile bodies, for example, a high-strength steel sheet having a thickness of about 1.0 to 4.0 mm has been desired as a steel sheet material. However, with an increase in the strength of a steel sheet, workability of the steel sheet decreases and it becomes difficult to work the steel sheet into a member having a desired shape.

Consequently, as described in Great Britain Patent Application No. 1 490 535, a method for manufacturing a structural member, the method being called "hot pressing" or "die quench," has attracted attention in which a high strength is realized by working a heated steel sheet in a metal mold and simultaneously rapidly cooling the steel sheet. This manufacturing method has been practically used for manufacturing some members that require a TS of 1.0 to 1.5 GPa. In this method, since a steel sheet is heated to about 950° C. and is then worked at a high temperature, a problem in terms of workability in cold pressing can be reduced. Furthermore, this method is advantageous in that since quenching is performed with a water-cooled metal mold, the strength of a member can be increased by utilizing a transformation structure, and the amount of alloying elements added to the steel sheet material can be reduced.

However, in a hot-pressed steel sheet member described in GB '535, a surface hardness significantly decreases which may often result in a deterioration of wear resistance or the like.

It could therefore be helpful to provide a hot-pressed steel sheet member which has a TS of 980 to 2,130 MPa and in which a decrease in a surface hardness is small, a steel sheet for hot-press, and a method for manufacturing the hot-pressed steel sheet member. Note that, herein, the "TS" of a hot-pressed steel sheet member refers to a TS of a steel sheet constituting the member after hot pressing.

SUMMARY

We found the following:

i) A cause of the decrease in a surface hardness is a decarburized layer having a thickness of several tens of micrometers to several hundred micrometers, the decarburized layer being formed on a surface layer portion of a steel sheet while the steel sheet is heated prior to hot pressing and is then cooled by a series of treatments of the hot pressing.

ii) It is effective to add Sb to a steel sheet for hot-press in an amount of 0.002% to 0.03% by mass to prevent the formation of such a decarburized layer.

We thus provide a hot-pressed steel sheet member having a composition containing, by mass, C: 0.09% to 0.38%, Si: 0.05% to 2.0%, Mn: 0.5% to 3.0%, P: 0.05% or less, S: 0.05% or less, Al: 0.005% to 0.1%, N: 0.01% or less, Sb: 0.002% to 0.03%, and the balance being Fe and inevitable impurities, wherein a tensile strength TS is 980 to 2,130 MPa.

The hot-pressed steel sheet member may further contain, by mass, at least one selected from Ni: 0.01% to 5.0%, Cu: 0.01% to 5.0%, Cr: 0.01% to 5.0%, and Mo: 0.01% to 3.0%. The hot-pressed steel sheet member may further contain, by mass, at least one selected from Ti: 0.005% to 3.0%, Nb: 0.005% to 3.0%, V: 0.005% to 3.0%, and W: 0.005% to 3.0%; B: 0.0005% to 0.05%; or at least one selected from REM: 0.0005% to 0.01%, Ca: 0.0005% to 0.01%, and Mg: 0.0005% to 0.01% separately or at the same time.

By varying a C content range selected from, by mass, C: 0.34% to 0.38%, C: 0.29% or more and less than 0.34%, C: 0.21% or more and less than 0.29%, C: 0.14% or more and less than 0.21%, and C: 0.09% or more and less than 0.14%, it is possible to obtain hot-pressed steel sheet members at desired strength levels, i.e., strength levels of 1,960 to 2,130 MPa, 1,770 MPa or more and less than 1,960 MPa, 1,470 MPa or more and less than 1,770 MPa, 1,180 MPa or more and less than 1,470 MPa, and 980 MPa or more and less than 1,180 MPa, respectively, corresponding to the respective C contents.

In this case, in a hot-pressed steel sheet member having a C content of C: 0.14% or more and less than 0.21% or C: 0.21% or more and less than 0.29%, the content of Sb is preferably 0.002% to 0.01% from the standpoint of fatigue properties.

We also provide a steel sheet for hot-press having the above composition.

A hot-pressed steel sheet member at a desired strength level corresponding to the above C content range can be manufactured by a method including heating a steel sheet for hot-press having a carbon content selected from, by mass, C: 0.34% to 0.38%, C: 0.29% or more and less than 0.34%, C: 0.21% or more and less than 0.29%, C: 0.14% or more and less than 0.21%, and 0.09% or more and less than 0.14% at a heating rate of 1° C./sec or more, holding the steel sheet in a temperature range of an $Ac_3$ transformation point to ($Ac_3$ transformation point+150° C.) for 1 to 600 seconds, then starting hot pressing in a temperature range of 550° C. or higher, and conducting cooling at an average cooling rate of 3° C./sec or more down to 200° C.

In this case, after the hot pressing, preferably, the member is taken out from a metal mold and cooled with a liquid or gas.

It is thus possible to manufacture a hot-pressed steel sheet member which has a TS of 980 to 2,130 MPa and in which a decrease in a surface hardness is small. The hot-pressed steel sheet member is suitable for structural members for ensuring security at the time of collision such as a door guard, a side member, and a center pillar of automobiles.

DETAILED DESCRIPTION

Our methods, members and steel sheets will now be specifically described. Note that the notation of "%" regarding compositions represents "mass%" unless otherwise stated.

1) Composition of Hot-Pressed Steel Sheet Member

C: 0.09% to 0.38%

Carbon (C) is an element that improves the strength of a steel. It is necessary to set the C content to 0.09% or more to achieve a TS of a hot-pressed steel sheet member of 980 MPa or more. On the other hand, when the C content exceeds 0.38%, it is difficult to achieve a TS of 2,130 MPa or less. Accordingly, the C content is set to 0.09% to 0.38%. In particular, to obtain a TS of 1,960 to 2,130 MPa, the C content is preferably set to 0.34% to 0.38%. To obtain a TS of 1,770 MPa or more and less than 1,960 MPa, the C content is preferably set to 0.29% or more and less than 0.34%. To obtain a TS of 1,470 MPa or more and less than 1,770 MPa, the C content is preferably set to 0.21% or more and less than 0.29%. To obtain a TS of 1,180 MPa or more and less than 1,470 MPa, the C content is preferably set to 0.14% or more and less than 0.21%. To obtain a TS of 980 MPa or more and less than 1,180 MPa, the C content is preferably set to 0.09% or more and less than 0.14%.

Si: 0.05% to 2.0%

Silicon (Si) is an element that improves the strength of a steel similarly to C. It is necessary to set the Si content to 0.05% or more to achieve a TS of a hot-pressed steel sheet member of 980 MPa or more. On the other hand, when the Si content exceeds 2.0%, during hot rolling, the generation of a surface defect called red scale significantly increases, a rolling load increases, and ductility of the resulting hot-rolled steel sheet decreases. Accordingly, the Si content is set to 0.05% to 2.0%.

Mn: 0.5% to 3.0%

Manganese (Mn) is an element that is effective in improving hardenability. In addition, since Mn decreases an $Ac_3$ transformation point, Mn is an element that is also effective in decreasing a heating temperature before hot pressing. It is necessary to set the Mn content to 0.5% or more to exhibit these effects. On the other hand, when the Mn content exceeds 3.0%, Mn segregates, resulting in a decrease in the uniformity of properties of the steel sheet material and the hot-pressed steel sheet member. Accordingly, the Mn content is set to 0.5% to 3.0%. P: 0.05% or less When the P content exceeds 0.05%, P segregates, resulting in a decrease in the uniformity of properties of the steel sheet material and the hot-pressed steel sheet member, and toughness also significantly decreases. Accordingly, the P content is set to 0.05% or less. Note that an excessive dephosphorization treatment causes an increase in the cost, and thus the P content is preferably set to 0.001% or more.

S: 0.05% or less

When the S content exceeds 0.05%, the toughness of a hot-pressed steel sheet member decreases. Accordingly, the S content is set to 0.05% or less.

Al: 0.005% to 0.1%

Aluminum (Al) is added as a deoxidizer of a steel. It is necessary to set the Al content to 0.005% or more to exhibit this effect. On the other hand, an Al content exceeding 0.1% decreases blanking workability and hardenability of a steel sheet material. Accordingly, the Al content is set to 0.005% to 0.1%.

N: 0.01% or less

When the N content exceeds 0.01%, N forms a nitride of AN during hot rolling and during heating for performing hot pressing, and decreases blanking workability and hardenability of a steel sheet material. Accordingly, the N content is set to 0.01% or less.

Sb: 0.002% to 0.03%

Antimony (Sb) is the most important element and has an effect of suppressing a decarburized layer formed on a surface layer portion of a steel sheet while the steel sheet is heated prior to hot pressing and is then cooled by a series of treatments of the hot pressing. It is necessary to set the Sb content to 0.002% or more to exhibit this effect. More preferably, the Sb content is 0.003% or more. On the other hand, an Sb content exceeding 0.03% results in an increase in the rolling load, thereby decreasing productivity. Accordingly, the Sb content is set to 0.002% to 0.03%.

The hot-pressed steel sheet member is mainly applied to structural members for ensuring security at the time of collision such as a door guard, a side member, and a center pillar of automobiles. In particular, for a hot-pressed steel sheet member at a strength level of 1,180 MPa or more and less than 1,470 MPa or 1,470 MPa or more and less than 1,770 MPa, that is, preferably, for a hot-pressed steel sheet member having a C content of C: 0.14% or more and less than 0.21% or C: 0.21% or more and less than 0.29%, excellent fatigue properties are also often required. Therefore, in a hot-pressed steel sheet member having this C content, the Sb content is preferably set to 0.002% to 0.01%. This is because when the Sb content exceeds 0.01%, the fatigue properties tend to decrease.

The balance is Fe and inevitable impurities. However, for the reasons described below, it is preferable to incorporate at least one selected from Ni: 0.01% to 5.0%, Cu: 0.01% to 5.0%, Cr: 0.01% to 5.0%, and Mo: 0.01% to 3.0%; at least one selected from Ti: 0.005% to 3.0%, Nb: 0.005% to 3.0%, V: 0.005% to 3.0%, and W: 0.005% to 3.0%; B: 0.0005% to 0.05%; or at least one selected from REM: 0.0005% to 0.01%, Ca: 0.0005% to 0.01%, and Mg: 0.0005% to 0.01% separately or at the same time.

Ni: 0.01% to 5.0%

Nickel (Ni) is an element that is effective in increasing the strength of a steel and improving hardenability. The Ni content is preferably set to 0.01% or more to exhibit these effects. On the other hand, a Ni content exceeding 5.0% results in a significant increase in the cost, and thus the upper limit of the Ni content is preferably set to 5.0%.

Cu: 0.01% to 5.0%

Copper (Cu) is an element that is effective in increasing the strength of a steel and improving hardenability similarly to Ni. The Cu content is preferably set to 0.01% or more to exhibit these effects. On the other hand, a Cu content exceeding 5.0% results in a significant increase in the cost, and thus the upper limit of the Cu content is preferably set to 5.0%.

Cr: 0.01% to 5.0%

Chromium (Cr) is an element that is effective in increasing the strength of a steel and improving hardenability similarly to Cu and Ni. The Cr content is preferably set to 0.01% or more to exhibit these effects. On the other hand, a Cr content exceeding 5.0% results in a significant increase in the cost, and thus the upper limit of the Cr content is preferably set to 5.0%.

Mo: 0.01% to 3.0%

Molybdenum (Mo) is an element that is effective in increasing the strength of steel and improving hardenability similarly to Cu, Ni, and Cr. Molybdenum also has an effect of suppressing the growth of crystal grains to improve toughness by grain refining. The Mo content is preferably set to 0.01% or more to exhibit these effects. On the other hand, a Mo content exceeding 3.0% results in a significant increase in the cost, and thus the upper limit of the Mo content is preferably set to 3.0%.

Ti: 0.005% to 3.0%

Titanium (Ti) is an element that is effective in increasing the strength of steel and improving toughness by grain refining. In addition, Ti is an element that is effective in exhibiting an effect of improving hardenability due to solute B by forming a nitride in preference to B described below. The Ti content is preferably set to 0.005% or more to exhibit these effects. On the other hand, when the Ti content exceeds 3.0%, a rolling load during hot rolling significantly increases, and toughness of a hot-pressed steel sheet member decreases. Accordingly, the upper limit of the Ti content is preferably set to 3.0%.

Nb: 0.005% to 3.0%

Niobium (Nb) is an element that is effective in increasing the strength of steel and improving toughness by grain refining similarly to Ti. The Nb content is preferably set to 0.005% or more to exhibit these effects. On the other hand, when the Nb content exceeds 3.0%, precipitation of carbonitride increases, and ductility and delayed fracture resistance decrease. Accordingly, the upper limit of the Nb content is preferably set to 3.0%.

V: 0.005% to 3.0%

Vanadium (V) is an element that is effective in increasing the strength of steel and improving toughness by grain refining similarly to Ti and Nb. Furthermore, V precipitates as a precipitate or a crystal which functions as a trap site of hydrogen, thus improving hydrogen embrittlement resistance. The V content is preferably set to 0.005% or more to exhibit these effects. On the other hand, when the V content exceeds 3.0%, precipitation of carbonitride becomes significant, and ductility significantly decreases. Accordingly, the upper limit of the V content is preferably set to 3.0%.

W: 0.005% to 3.0%

Tungsten (W) is an element that is effective in increasing the strength of steel, improving toughness, and improving hydrogen embrittlement resistance similarly to V. The W content is preferably set to 0.005% or more to exhibit these effects. On the other hand, when the W content exceeds 3.0%, ductility significantly decreases. Accordingly, the upper limit of the W content is preferably set to 3.0%.

B: 0.0005% to 0.05%

Boron (B) is an element that is effective in improving hardenability during hot pressing and improving toughness after hot pressing. The B content is preferably set to 0.0005% or more to exhibit these effects. On the other hand, when the B content exceeds 0.05%, a rolling load during hot rolling significantly increases, and a martensite phase and a bainite phase are formed after hot rolling, resulting in the formation of cracks and the like of a steel sheet. Accordingly, the upper limit of the B content is preferably set to 0.05%.

REM: 0.0005% to 0.01%

A rare earth metal (REM) is an element that is effective in controlling the form of inclusions and contributes to an improvement in ductility and hydrogen embrittlement resistance. The REM content is preferably set to 0.0005% or more to exhibit these effects. On the other hand, a REM content exceeding 0.01% deteriorates hot workability, and thus the upper limit of the REM content is preferably set to 0.01%.

Ca: 0.0005% to 0.01%

Calcium (Ca) is an element that is effective in controlling the form of inclusions and contributes to an improvement in ductility and hydrogen embrittlement resistance similarly to REMs. The Ca content is preferably set to 0.0005% or more to exhibit these effects. On the other hand, a Ca content exceeding 0.01% deteriorates hot workability, and thus the upper limit of the Ca content is preferably set to 0.01%.

Mg: 0.0005% to 0.01%

Magnesium (Mg) is also an element that is effective in controlling the form of inclusions, improves ductility and contributes to an improvement in hydrogen embrittlement resistance by forming a composite precipitate or a composite crystal with other elements. The Mg content is preferably set to 0.0005% or more to exhibit these effects. On the other hand, when the Mg content exceeds 0.01%, coarse oxide and sulfide are formed, thereby decreasing ductility. Accordingly, the upper limit of the Mg content is preferably set to 0.01%.

The microstructure of the hot-pressed steel sheet member may be a quenched microstructure obtained by normal hot pressing and is not particularly limited. In general, in hot pressing, a heated steel sheet is worked in a metal mold and is simultaneously rapidly cooled. Accordingly, a quenched microstructure mainly composed of a martensite phase tends to be formed in our composition range.

Furthermore, for some hot-pressed steel sheet members, though not for all members, after press forming, for example, perforation and burring work may be performed at a specific position of the members, and screw-thread cutting for fastening with a bolt may be performed. In the case where such burring work is performed from the standpoint of providing good workability thereto, the microstructure is preferably close to a single-phase microstructure. From this standpoint, the microstructure is preferably a microstructure close to a single martensite phase, and the area ratio of the martensite phase to the whole microstructure is preferably controlled to be 90% or more. In addition, from the standpoint that a TS of 980 to 2,130 MPa is reliably achieved, it is also preferable to control the area ratio of the martensite phase to the whole microstructure to be 90% or more. This is because when the area ratio of the martensite phase is less than 90%, a TS of 980 MPa or more may not be achieved at low C contents.

As described above, the area ratio of the martensite phase is preferably 90% or more from the standpoint of burring workability, a stable realization of the strength, and a reduction in the cost realized by achieving a necessary strength by adding components in an amount as small as possible. The area ratio of the martensite phase is more preferably 96% or more, and may be 100%. Microstructures other than the martensite phase may be various microstructures such as a bainite phase, a retained austenite phase, a cementite phase, a pearlite phase, and a ferrite phase.

The area ratio of the martensite phase or other phases in the microstructure can be determined by image analysis of a microstructure photograph.

A decarburized layer is formed on a surface layer of a steel sheet together with scale when heat treatment is conducted in an oxidizing atmosphere such as in air. In this case, crystal grain boundaries become preferential diffusion path of atoms, as compared with the inside of crystal grains. Consequently, oxidation easily proceeds at grain boundaries, and an eroded pit called "grain-boundary oxidized part" is formed. It is believed that Sb is concentrated on a surface layer of a steel sheet at the same time of the generation of scale, thereby suppressing oxidation and decarburization. Formation and growth of the grain-boundary oxidized part described above are also suppressed by the concentration of Sb. As in the case of fatigue breaking, in the case where a stress is repeatedly applied, cracks are easily formed in abnormal portions such as a portion having a different hardness and a pit of a steel sheet constituting a member. Accordingly, it is effective to reduce these abnormal portions to improve fatigue properties. It is believed that since formation of pits due to oxidation erosion is suppressed by adding Sb, a source of crack formation is reduced, thereby improving fatigue properties. However, since the atomic size of Sb is larger than that of iron, the Sb-concentrated part is hardened. In the case where Sb is excessively concentrated, a repeated stress is concentrated in the Sb-concentrated part which may become a source of crack formation. Therefore, in the case where fatigue properties are also required, it is preferable to suppress formation of an excessive Sb-concentrated part on a surface layer of a steel sheet before hot pressing.

The Sb concentration can be evaluated by the following method.

Evaluation method of Sb concentration: The amount of Sb concentration on a surface layer of a steel sheet before hot pressing can be measured by a line analysis in which an electron beam is linearly scanned on the surface layer of the steel sheet or an area analysis in which an electron beam is scanned in a quadrangular shape thereon using an electron probe micro-analyzer (EPMA) with energy-dispersive X-ray spectroscopy (EDS) for measuring energy of characteristic X-rays inherent to elements or wavelength-dispersive X-ray spectroscopy (WDS) for measuring the wavelength thereof. In this case, although measurement conditions such as an accelerating voltage depend on the apparatus, it is sufficient that the amount of count of Sb detected with the above detector is set to 20 or more. For example, in the case where the measurement time is reduced, it is sufficient that the scanning length of the electron beam in the line analysis is set to 15 mm or more in total, and that the scanning area in the area analysis is set to a quadrangle having a side of 2 mm or more. A ratio Sb-max/Sb-ave of the maximum intensity Sb-max to the average intensity Sb-ave of Sb in the measurement area is used as an evaluation index of the Sb concentration. When the ratio Sb-max/Sb-ave is 5 or less, propagation of cracks at the time of fatigue can be suppressed on a surface layer of a steel sheet after hot pressing.

2) Steel Sheet for Hot-Press

Steel sheets such as a hot-rolled steel sheet, an as cold-rolled steel sheet having a microstructure composed of a cold-rolled microstructure, and a cold-rolled steel sheet annealed after cold rolling, all of which have the composition of the hot-pressed steel sheet member described above, can be used as a steel sheet for hot-pressing.

Steel sheets manufactured under the usual conditions can be used for these steel sheets. For example, as the hot-rolled steel sheet, it is possible to use a steel sheet obtained by hot-rolling a steel slab having the above composition at a finish rolling entry-side temperature of 1,100° C. or lower and at a finish rolling exit-side temperature in the range of an $Ac_3$ transformation point to ($Ac_3$ transformation point+50° C.), cooling the resulting hot-rolled steel sheet under a normal cooling condition, and coiling the steel sheet at a normal coiling temperature. As the as cold-rolled steel sheet, a steel sheet obtained by cold-rolling the above hot-rolled steel sheet can be used. In this case, the rolling reduction in the cold rolling is preferably 30% or more, and more preferably 50% or more to prevent exaggerated grain growth during heating before hot pressing and during subsequent annealing. The upper limit of the rolling reduction is preferably 85% because the rolling load increases, thereby decreasing productivity. Furthermore, as the cold-rolled steel sheet annealed after cold rolling, it is preferable to use a steel sheet obtained by annealing the above-described as cold-rolled steel sheet at an annealing temperature of the $Ac_1$ transformation point or lower in a continuous annealing line. A steel sheet obtained by annealing at an annealing temperature higher than the $Ac_1$ transformation point may also be used. However, care should be taken because a hard second phase such as a martensite phase, a bainite phase, or a pearlite phase is formed in the microstructure after annealing, and thus the strength of the steel sheet may become excessively high.

It is preferable to avoid excessive Sb concentration on a surface layer of a steel sheet after hot rolling to improve fatigue properties. For this purpose, the following method is effective: Specifically, at the time of hot rolling that is continuously performed after heating of a slab, in addition to descaling that is usually performed immediately before rolling to prevent scratches from being formed when scale is pressed on a steel sheet by the rolling, descaling is repeatedly performed after rolling three times or more at a rolling reduction of 15% or more in a high-temperature range of 1,000° C. or higher in which formation of scale significantly occurs. That is, it is effective to repeat the rolling and descaling three times or more. The reason why the descaling is performed at a rolling reduction of 15% or more is as follows. In the case where descaling is performed in a state where scale is broken to some extent by rolling at a rolling reduction of 15% or more, the scale is effectively removed and excessive Sb concentration is prevented to achieve homogenization. Note that, in this case, it is sufficient that a water-stream collision pressure in the descaling is 5 MPa or more.

3) Hot-Press Conditions

Conditions for hot pressing that are usually conducted may be used as hot-press conditions. As described above, from the standpoint of obtaining a microstructure close to a single martensite phase, i.e., a microstructure having 90% or more of a martensite phase in terms of area ratio, the following hot-press conditions are preferable. In the cases of the hot-press conditions described below, a hot-pressed steel sheet member at a desired strength level can be easily manufactured by adjusting a C content range. For example, to obtain a TS of 1,960 to 2,130 MPa, the C content is adjusted to be 0.34% to 0.38%. To obtain a TS of 1,770 MPa or more and less than 1,960 MPa, the C content is adjusted to be 0.29% or more and less than 0.34%. To obtain a TS of 1,470 MPa or more and less than 1,770 MPa, the C content is adjusted to be 0.21% or more and less than 0.29%. To obtain a TS of 1,180 MPa or more and less than 1,470 MPa, the C content is adjusted to be 0.14% or more and less than 0.21%. To obtain a TS of 980 MPa or more and less than 1,180 MPa, the C content is adjusted to be 0.09% or more and less than 0.14%. Thus, a hot-pressed steel sheet member at any of the above desired strength levels can be stably obtained. A preferred manufacturing method for obtaining a microstructure having 90% or more of the martensite phase in terms of area ratio will now be described by taking, as an example, a case where a hot-pressed steel sheet member at a desired strength level corresponding to the above C content range is manufactured. Specifically, a steel sheet for hot-press having a carbon content selected from, by mass, C: 0.34% to 0.38%, C: 0.29% or more and less than 0.34%, C: 0.21% or more and less than 0.29%, C: 0.14% or more and less than 0.21%, and 0.09% or more and less than 0.14% is heated at a heating rate of 1° C./sec or more, and held in a temperature range of an $Ac_3$ transformation point, at which the microstructure becomes a single austenite phase, to ($Ac_3$ transformation point+150° C.) for 1 to 600 seconds, hot pressing is then started in a temperature range of 550° C. or higher, and cooling is conducted at an average cooling rate of 3° C./sec or more down to 200° C.

The reason why the heating rate is set to 1° C./sec or more is that, when the heating rate is lower than 1° C./sec, productivity decreases, and austenite grains cannot be refined during heating, resulting in a decrease in toughness of the member after quenching. From the standpoint of refining the prior austenite grains of the member, the heating rate is preferably high and more preferably 3° C./sec or more. The heating rate is still more preferably 5° C./sec or more.

The reason why the heating temperature is set to a temperature range of the $Ac_3$ transformation point to ($Ac_3$ transformation point+150° C.) is as follows. When the heating temperature is lower than the $Ac_3$ transformation point, a ferrite phase is formed after quenching and the resulting steel sheet becomes soft, and thus a desired TS corresponding to each of the C content ranges cannot be obtained. On the other hand, when the heating temperature is higher than ($Ac_3$ transformation point+150° C.), this condition is disadvantageous in terms of thermal efficiency and the amount of scale formed on the surface of the steel sheet increases, resulting in an increase in the load of a subsequent scale removal treatment such as shot blasting. To increase the thermal efficiency and reduce the amount of scale formed as much as possible, a temperature range of the $Ac_3$ transformation point to ($Ac_3$ transformation point+100° C.) is preferable, and a temperature range of the $Ac_3$ transformation point to ($Ac_3$ transformation point+50° C.) is more preferable.

Note that the $Ac_3$ transformation point can be determined without causing practical problems by the following empirical formula:

$Ac_3$ transformation point=881−206C+53Si−15Mn−20Ni−1Cr−27Cu+41Mo wherein the symbols of elements represent the contents (mass %) of the respective elements.

The reason why the holding time is set to 1 to 600 seconds is as follows. When the holding time is less than 1 second, a sufficient amount of austenite phase is not formed during heating, and the area ratio of the martensite phase after quenching decreases. Thus, a desired TS corresponding each of the C content ranges cannot be obtained. When the holding time exceeds 600 seconds, this condition is disadvantageous in terms of thermal efficiency and the amount of scale formed on the surface of the steel sheet increases, resulting in an increase in the load of a subsequent scale removal treatment such as shot blasting. In the case where the holding time is excessively long, the effect of preventing the formation of a decarburized layer, the effect being caused by Sb, becomes insufficient. Furthermore, the surface concentration of Sb may become uneven. Accordingly, the holding time is more preferably 1 to 300 seconds.

The reason why the temperature at which the hot pressing is started is set to 550° C. or higher is as follows. When the temperature is lower than 550° C., a soft ferrite phase or bainite phase is excessively formed during the cooling process and it becomes difficult to achieve a desired TS corresponding each of the C content ranges.

After the start of the hot pressing, the steel sheet is formed to have a shape of a member and cooled in a metal mold for hot pressing. Alternatively, after the steel sheet is formed to have a shape of a member, the member is taken out from the metal mold either immediately or in the course of cooling in the metal mold, and cooled. It is necessary that the cooling after the start of the hot pressing be conducted at an average cooling rate of 3° C./sec or more down to 200° C. to ensure the area ratio of the martensite phase. As for the cooling method, for example, a punch is held at a bottom dead point for 1 to 60 seconds during hot pressing, and the member is cooled using the die and punch. Alternatively, the member may be cooled by air cooling in combination with the above cooling. Furthermore, from the standpoint of an improvement in productivity and an achievement of a desired TS corresponding to each of the C content ranges, it is preferable to take out the member from the metal mold after hot pressing, and cool the member with a liquid or gas. Note that the cooling rate is preferably about 400° C./sec or less from the standpoint that the production cost is not excessively increased.

EXAMPLE 1

Hot-pressed steel sheet member Nos. 1 to 22 having a hat shape were prepared by conducting heating, holding, hot pressing, and cooling under the hot-press conditions shown in Table 2 using steel sheet Nos. A to P shown in Table 1. Note that the $Ac_3$ transformation point shown in Table 1 was determined by the above empirical formula.

A metal mold used in the hot pressing has a punch width of 70 mm, a punch shoulder of R4 mm, a die shoulder of R4 mm, and a forming depth of 30 mm. The heating was conducted by using either an infrared heating furnace or an atmosphere heating furnace in accordance with the heating rate in an atmosphere of 95% by volume $N_2$+5% by volume $O_2$. The cooling was conducted from the press (starting) temperature to 150° C. by combining cooling in a state where a steel sheet was sandwiched between the punch and the die with air cooling on the die after releasing from the sandwiched state. In this step, the cooling rate was adjusted by varying the time during which the punch was held at the bottom dead point in the range of 1 to 60 seconds. One of the members (member No. 20) was taken out from the metal mold immediately after the formation by hot pressing and subjected to accelerated cooling with air. In this case, the cooling rate in the above cooling was determined as the average cooling rate from the press starting temperature to 200° C. The temperature was measured at a position of the bottom of the hat with a thermocouple.

A JIS No. 5 tensile test specimen was prepared from a bottom position of the hat of each of the prepared hot-pressed steel sheet members so that a direction parallel to the rolling direction of the steel sheet corresponded to the tensile direction. A tensile test was conducted in accordance with JIS Z 2241 to measure the TS. In preparation of the tensile test specimen, after the specimen was finished by normal machining, parallel portions and R portions (shoulder portions) were polished with paper of #300 to #1,500, and buffing was further performed with a diamond paste to remove the damage due to the machining. The reason for this is as follows: In the case where the TS is at an ultra-high strength level as in our steel sheets, when normal machining is merely performed, early fracture occurs at the time of the tensile test from a damaged portion (such as a small scratch) due to the machining Accordingly, the original TS cannot be evaluated. In addition, the microstructure near a portion from which the tensile test specimen had been cut out was examined by the following method.

A small strip was cut out from a portion near the portion from which the tensile test specimen had been cut out. The small strip was subjected to pickling to remove scale on a surface thereof. The Vickers hardness of the surface was then measured in accordance with JIS Z 2244 at a load of 10 kgf (98.07 N). The number of measuring points was ten, and the average of these measuring points was determined. To clarify the degree of decrease in the surface hardness, a cross section of the small strip in the thickness direction of the steel sheet was polished and the Vickers hardness of a central portion in the thickness direction of the steel sheet was measured in accordance with JIS Z 2244 at a load of 2 kgf (19.61 N). The number of measuring points was five and the average of these measuring points was determined.

Furthermore, a small strip was cut out from a portion near the portion from which the tensile test specimen had been cut out. A cross section of the small strip in the thickness direction of the steel sheet was polished and corroded with nital. Scanning electron microscope (SEM) images of two fields of view were taken at a position located at about ¼ from an edge of the steel sheet in the thickness direction thereof to examine whether the microstructure was a martensite phase or a phase other than a martensite phase. The area ratio of the martensite phase was measured by image analysis. In this case, the area ratio was defined as the average of the two fields of view.

Table 2 shows the results. Hot-pressed steel sheet member No. 10 corresponds to a case where the C content exceeds the upper limit of our C content, and has a TS exceeding the target of 2,130 MPa. Accordingly, there is a concern that since ductility is extremely insufficient, brittle fracture occurs when an automobile collides, and a necessary amount of collision energy absorption cannot be obtained. Hot-pressed steel sheet member No. 11 has an Sb content lower than the lower limit of our range, and the decrease in the surface hardness of this hot-pressed steel sheet member is more significant than that of hot-pressed steel sheet member No. 4 which had substantially the same composition and was manufactured under substantially the same manufacturing conditions. Hot-pressed steel sheet members other than the above are examples of our steel sheet members. It is found that these hot-pressed steel sheet members each have a TS in the range of 980 to 2,130 MPa, and the decrease in the surface hardness is also small. In particular, in hot-pressed steel sheet member Nos. 1, 4, 5, 8, and 12 to 22, which were manufactured under the above-described preferred hot-press conditions using our steel sheets having a C content of 0.34% to 0.38%, it is found that a desired TS: 1,960 to 2,130 MPa corresponding to the C content range: 0.34% to 0.38% is obtained as described above and the decrease in the surface hardness is also small.

TABLE 1

| Steel sheet | Composition (mass %) | | | | | | | | | $Ac_3$ transformation point | Type of | Thickness | |
|---|---|---|---|---|---|---|---|---|---|---|---|---|---|
| No. | C | Si | Mn | P | S | Al | N | Sb | Others | (° C.) | steel sheet | (mm) | Remark |
| A | 0.37 | 0.81 | 1.83 | 0.02 | 0.003 | 0.042 | 0.004 | 0.004 | — | 820 | Hot-rolled steel sheet | 2.3 | Within our range |
| B | 0.35 | 0.12 | 2.36 | 0.02 | 0.003 | 0.049 | 0.004 | 0.006 | — | 780 | As cold-rolled steel sheet (Cold rolling reduction: 50%) | 1.6 | Within our range |
| C | 0.36 | 0.19 | 2.41 | 0.02 | 0.005 | 0.038 | 0.004 | 0.010 | — | 781 | As cold-rolled steel sheet (Cold rolling reduction: 50%) | 1.6 | Within our range |
| D | 0.34 | 0.15 | 1.42 | 0.01 | 0.007 | 0.037 | 0.005 | 0.027 | — | 798 | Cold-rolled steel sheet | 1.2 | Within our range |
| E | 0.31 | 0.19 | 1.37 | 0.01 | 0.005 | 0.035 | 0.003 | 0.006 | — | 807 | As cold-rolled steel sheet (Cold rolling reduction: 50%) | 1.6 | Within our range |
| F | 0.40 | 0.26 | 1.45 | 0.02 | 0.004 | 0.041 | 0.003 | 0.005 | — | 791 | As cold-rolled steel sheet (Cold rolling reduction: 50%) | 1.6 | Out of our range |
| G | 0.34 | 0.16 | 1.41 | 0.01 | 0.004 | 0.034 | 0.004 | <0.001 | — | 798 | As cold-rolled steel sheet (Cold rolling reduction: 50%) | 1.6 | Out of our range |
| H | 0.34 | 0.27 | 1.86 | 0.01 | 0.005 | 0.036 | 0.004 | 0.007 | Ni: 1.1, Cu: 0.2 | 770 | As cold-rolled steel sheet (Cold rolling reduction: 50%) | 1.6 | Within our range |
| I | 0.36 | 0.22 | 1.31 | 0.02 | 0.006 | 0.044 | 0.004 | 0.006 | Cr: 0.7, Mo: 0.3 | 810 | As cold-rolled steel sheet (Cold rolling reduction: 50%) | 1.6 | Within our range |
| J | 0.36 | 0.25 | 1.45 | 0.01 | 0.004 | 0.046 | 0.005 | 0.004 | Ti: 0.04, Nb: 0.05 | 798 | As cold-rolled steel sheet (Cold rolling reduction: 50%) | 1.6 | Within our range |
| K | 0.35 | 0.18 | 1.45 | 0.01 | 0.003 | 0.034 | 0.003 | 0.014 | V: 0.06, W: 0.04 | 797 | As cold-rolled steel sheet (Cold rolling reduction: 50%) | 1.6 | Within our range |
| L | 0.37 | 0.16 | 1.62 | 0.02 | 0.006 | 0.026 | 0.004 | 0.004 | B: 0.0018 | 789 | As cold-rolled steel sheet (Cold rolling reduction: 50%) | 1.6 | Within our range |
| M | 0.35 | 0.12 | 1.68 | 0.02 | 0.005 | 0.043 | 0.004 | 0.007 | Sc(REM): 0.008 | 790 | As cold-rolled steel sheet (Cold rolling reduction: 50%) | 1.6 | Within our range |
| N | 0.34 | 0.16 | 1.43 | 0.01 | 0.005 | 0.031 | 0.003 | 0.006 | Ca: 0.0016, Mg: 0.0017 | 798 | As cold-rolled steel sheet (Cold rolling reduction: 50%) | 1.6 | Within our range |
| O | 0.35 | 0.19 | 1.33 | 0.01 | 0.004 | 0.052 | 0.004 | 0.007 | — | 799 | As cold-rolled steel sheet (Cold rolling reduction: 63%) | 1.2 | Within our range |
| P | 0.35 | 0.23 | 1.24 | 0.02 | 0.005 | 0.036 | 0.005 | 0.011 | — | 802 | As cold-rolled steel sheet (Cold rolling reduction: 44%) | 1.8 | Within our range |

TABLE 2

| | | Hot-press conditions | | | | | | Hardness | | Area ratio of | |
|---|---|---|---|---|---|---|---|---|---|---|---|
| Hot-pressed steel sheet member No. | Steel sheet No. | Heating rate (° C./sec) | Heating temperature (° C.) | Holding time (sec) | Press starting temperature (° C.) | Cooling rate (° C./sec) | TS (MPa) | Surface | Center of sheet thickness | martensite phase (%) | Remark |
| 1 | A | 15 | 930 | 120 | 650 | 60 | 2120 | 620 | 655 | 100 | Example |
| 2 | | 15 | 780 | 120 | 650 | 60 | 1892 | 544 | 586 | 70 | Example |
| 3 | | 15 | 880 | 0 | 650 | 60 | 1927 | 553 | 592 | 75 | Example |
| 4 | B | 15 | 860 | 120 | 650 | 60 | 2023 | 598 | 624 | 100 | Example |

TABLE 2-continued

| Hot-pressed steel sheet member No. | Steel sheet No. | Hot-press conditions: Heating rate (° C./sec) | Heating temperature (° C.) | Holding time (sec) | Press starting temperature (° C.) | Cooling rate (° C./sec) | TS (MPa) | Hardness: Surface | Center of sheet thickness | Area ratio of martensite phase (%) | Remark |
|---|---|---|---|---|---|---|---|---|---|---|---|
| 5 | C | 15 | 840 | 120 | 650 | 60 | 2004 | 603 | 617 | 100 | Example |
| 6 | | 15 | 850 | 120 | 350 | 60 | 1931 | 580 | 596 | 75 | Example |
| 7 | | 15 | 840 | 120 | 650 | 1 | 1916 | 578 | 593 | 85 | Example |
| 8 | D | 15 | 860 | 120 | 650 | 60 | 1967 | 593 | 607 | 100 | Example |
| 9 | E | 15 | 900 | 120 | 650 | 60 | 1883 | 557 | 583 | 100 | Example |
| 10 | F | 15 | 890 | 120 | 650 | 60 | 2160 | 640 | 668 | 100 | Comparative Example |
| 11 | G | 15 | 860 | 120 | 650 | 60 | 1965 | 479 | 605 | 100 | Comparative Example |
| 12 | H | 15 | 840 | 120 | 650 | 60 | 1967 | 579 | 602 | 100 | Example |
| 13 | I | 15 | 890 | 120 | 650 | 60 | 2069 | 610 | 636 | 100 | Example |
| 14 | J | 15 | 880 | 120 | 650 | 60 | 2058 | 600 | 635 | 100 | Example |
| 15 | K | 15 | 890 | 120 | 650 | 60 | 2004 | 606 | 620 | 100 | Example |
| 16 | L | 15 | 900 | 120 | 650 | 60 | 2091 | 613 | 648 | 100 | Example |
| 17 | M | 15 | 890 | 120 | 650 | 60 | 1972 | 586 | 609 | 100 | Example |
| 18 | N | 15 | 880 | 120 | 650 | 60 | 1964 | 581 | 607 | 100 | Example |
| 19 | O | 15 | 890 | 540 | 650 | 60 | 2058 | 610 | 633 | 100 | Example |
| 20 | | 15 | 870 | 120 | 650 | 15 | 2043 | 609 | 634 | 100 | Example |
| 21 | | 2 | 860 | 120 | 650 | 60 | 2061 | 609 | 633 | 100 | Example |
| 22 | P | 15 | 910 | 120 | 650 | 60 | 1968 | 595 | 609 | 100 | Example |

EXAMPLE 2

Hot-pressed steel sheet member Nos. 1 to 22 having a hat shape were prepared by conducting heating, holding, hot pressing, and cooling under the hot-press conditions shown in Table 4 using steel sheet Nos. A to P shown in Table 3.

The same tests as those in Example 1 were conducted to measure the TS, the Vickers hardness of a surface and a central portion in the thickness direction of the steel sheet, and the area ratio of a martensite phase of each of the hot-pressed steel sheet members.

Table 4 shows the results. Hot-pressed steel sheet member No. 11 has an Sb content lower than the lower limit of our range and the decrease in the surface hardness of this hot-pressed steel sheet member is more significant than that of hot-pressed steel sheet member No. 4 which had substantially the same composition and was manufactured under substantially the same manufacturing conditions. Hot-pressed steel sheet members other than the above are examples of our steel sheet members. It is found that these hot-pressed steel sheet members each have a TS in the range of 980 to 2,130 MPa, and the decrease in the surface hardness is also small. In particular, in hot-pressed steel sheet member Nos. 1, 4, 5, 8, and 12 to 22, which were manufactured under the above-described preferred hot-press conditions using our steel sheets having a C content of 0.29% or more and less than 0.34%, it is found that a desired TS: 1,770 MPa or more and less than 1,960 MPa corresponding to the C content range: 0.29% or more and less than 0.34% is obtained as described above and the decrease in the surface hardness is also small.

TABLE 3

| Steel sheet No. | Composition (mass %): C | Si | Mn | P | S | Al | N | Sb | Others | $Ac_3$ transformation point (° C.) | Type of steel sheet | Thickness (mm) | Remark |
|---|---|---|---|---|---|---|---|---|---|---|---|---|---|
| A | 0.33 | 1.03 | 1.71 | 0.01 | 0.004 | 0.034 | 0.004 | 0.003 | — | 842 | Hot-rolled steel sheet | 2.3 | Within our range |
| B | 0.30 | 0.14 | 2.68 | 0.02 | 0.005 | 0.036 | 0.003 | 0.006 | — | 786 | As cold-rolled steel sheet (Cold rolling reduction: 50%) | 1.6 | Within our range |
| C | 0.31 | 0.23 | 2.43 | 0.01 | 0.004 | 0.037 | 0.004 | 0.011 | — | 793 | As cold-rolled steel sheet (Cold rolling reduction: 50%) | 1.6 | Within our range |
| D | 0.30 | 0.21 | 1.30 | 0.01 | 0.005 | 0.041 | 0.005 | 0.029 | — | 811 | Cold-rolled steel sheet | 1.2 | Within our range |
| E | 0.26 | 0.15 | 1.49 | 0.02 | 0.006 | 0.042 | 0.004 | 0.004 | — | 813 | As cold-rolled steel sheet (Cold rolling reduction: 50%) | 1.6 | Within our range |
| F | 0.35 | 0.18 | 1.34 | 0.01 | 0.003 | 0.049 | 0.003 | 0.007 | — | 798 | As cold-rolled steel sheet (Cold rolling reduction: 50%) | 1.6 | Within our range |
| G | 0.29 | 0.14 | 1.40 | 0.03 | 0.003 | 0.033 | 0.003 | <0.001 | — | 808 | As cold-rolled steel sheet (Cold rolling reduction: 50%) | 1.6 | Out of our range |
| H | 0.31 | 0.21 | 1.82 | 0.02 | 0.004 | 0.038 | 0.004 | 0.006 | Ni: 1.2, Cu: 0.4 | 766 | As cold-rolled steel sheet (Cold rolling reduction: 50%) | 1.6 | Within our range |
| I | 0.30 | 0.20 | 1.52 | 0.02 | 0.004 | 0.037 | 0.004 | 0.005 | Cr: 0.6, Mo: 0.5 | 827 | As cold-rolled steel sheet (Cold rolling reduction: 50%) | 1.6 | Within our range |
| J | 0.32 | 0.19 | 1.43 | 0.01 | 0.005 | 0.037 | 0.005 | 0.007 | Ti: 0.06, Nb: 0.04 | 804 | As cold-rolled steel sheet (Cold rolling reduction: 50%) | 1.6 | Within our range |
| K | 0.29 | 0.16 | 1.56 | 0.02 | 0.003 | 0.029 | 0.003 | 0.008 | V: 0.06, W: 0.04 | 806 | As cold-rolled steel sheet (Cold rolling reduction: 50%) | 1.6 | Within our range |

TABLE 3-continued

| Steel sheet No. | Composition (mass %) C | Si | Mn | P | S | Al | N | Sb | Others | $Ac_3$ transformation point (° C.) | Type of steel sheet | Thickness (mm) | Remark |
|---|---|---|---|---|---|---|---|---|---|---|---|---|---|
| L | 0.30 | 0.18 | 1.37 | 0.01 | 0.005 | 0.046 | 0.004 | 0.014 | B: 0.0016 | 808 | As cold-rolled steel sheet (Cold rolling reduction: 50%) | 1.6 | Within our range |
| M | 0.30 | 0.12 | 1.49 | 0.02 | 0.006 | 0.048 | 0.003 | 0.012 | Sc(REM): 0.007 | 803 | As cold-rolled steel sheet (Cold rolling reduction: 50%) | 1.6 | Within our range |
| N | 0.31 | 0.13 | 1.67 | 0.01 | 0.004 | 0.042 | 0.005 | 0.005 | Ca: 0.0026, Mg: 0.0023 | 799 | As cold-rolled steel sheet (Cold rolling reduction: 50%) | 1.6 | Within our range |
| O | 0.29 | 0.17 | 1.35 | 0.03 | 0.007 | 0.052 | 0.003 | 0.007 | — | 810 | As cold-rolled steel sheet (Cold rolling reduction: 63%) | 1.2 | Within our range |
| P | 0.30 | 0.18 | 1.49 | 0.02 | 0.006 | 0.045 | 0.005 | 0.010 | — | 806 | As cold-rolled steel sheet (Cold rolling reduction: 44%) | 1.8 | Within our range |

TABLE 4

| Hot-pressed steel sheet member No. | Steel sheet No. | Hot-press conditions: Heating rate (° C./sec) | Heating temperature (° C.) | Holding time (sec) | Press starting temperature (° C.) | Cooling rate (° C./sec) | TS (MPa) | Hardness: Surface | Hardness: Center of sheet thickness | Area ratio of martensite phase (%) | Remark |
|---|---|---|---|---|---|---|---|---|---|---|---|
| 1 | A | 15 | 960 | 120 | 650 | 60 | 1928 | 560 | 596 | 100 | Example |
| 2 | | 15 | 810 | 120 | 650 | 60 | 1720 | 492 | 535 | 80 | Example |
| 3 | | 15 | 920 | 0 | 650 | 60 | 1713 | 489 | 529 | 80 | Example |
| 4 | B | 15 | 840 | 120 | 650 | 60 | 1864 | 552 | 574 | 100 | Example |
| 5 | C | 15 | 850 | 120 | 650 | 60 | 1846 | 563 | 575 | 100 | Example |
| 6 | | 15 | 860 | 120 | 350 | 60 | 1742 | 525 | 539 | 75 | Example |
| 7 | | 15 | 850 | 120 | 650 | 1 | 1749 | 529 | 540 | 80 | Example |
| 8 | D | 15 | 860 | 120 | 650 | 60 | 1806 | 543 | 555 | 100 | Example |
| 9 | E | 15 | 890 | 120 | 650 | 60 | 1674 | 489 | 519 | 100 | Example |
| 10 | F | 15 | 880 | 120 | 650 | 60 | 2022 | 605 | 624 | 100 | Example |
| 11 | G | 15 | 900 | 120 | 650 | 60 | 1779 | 439 | 547 | 100 | Comparative Example |
| 12 | H | 15 | 840 | 120 | 650 | 60 | 1840 | 550 | 572 | 100 | Example |
| 13 | I | 15 | 890 | 120 | 650 | 60 | 1805 | 529 | 553 | 100 | Example |
| 14 | J | 15 | 880 | 120 | 650 | 60 | 1934 | 579 | 598 | 100 | Example |
| 15 | K | 15 | 880 | 120 | 650 | 60 | 1783 | 531 | 548 | 100 | Example |
| 16 | L | 15 | 870 | 120 | 650 | 60 | 1863 | 561 | 573 | 100 | Example |
| 17 | M | 15 | 880 | 120 | 650 | 60 | 1845 | 555 | 567 | 100 | Example |
| 18 | N | 15 | 890 | 120 | 650 | 60 | 1875 | 556 | 580 | 100 | Example |
| 19 | O | 15 | 910 | 540 | 650 | 60 | 1800 | 539 | 558 | 100 | Example |
| 20 | | 15 | 890 | 120 | 650 | 15 | 1786 | 535 | 556 | 100 | Example |
| 21 | | 2 | 870 | 120 | 650 | 60 | 1806 | 536 | 556 | 100 | Example |
| 22 | P | 15 | 870 | 120 | 650 | 60 | 1825 | 546 | 558 | 100 | Example |

EXAMPLE 3

Hot-pressed steel sheet member Nos. 1 to 22 having a hat shape were prepared by conducting heating, holding, hot pressing, and cooling under the hot-press conditions shown in Table 6 using steel sheet Nos. A to P shown in Table 5.

The same tests as those in Example 1 were conducted to measure the TS, the Vickers hardness of a surface and a central portion in the thickness direction of the steel sheet, and the area ratio of a martensite phase of each of the hot-pressed steel sheet members.

Table 6 shows the results. Hot-pressed steel sheet member No. 11 has an Sb content lower than the lower limit of our range and the decrease in the surface hardness of this hot-pressed steel sheet member is more significant than that of hot-pressed steel sheet member No. 4 which had substantially the same composition and was manufactured under substantially the same manufacturing conditions. Hot-pressed steel sheet members other than the above are examples of our steel sheet members. It is found that these hot-pressed steel sheet members each have a TS in the range of 980 to 2,130 MPa, and the decrease in the surface hardness is also small. In particular, in hot-pressed steel sheet member Nos. 1, 4, 5, 8, and 12 to 22, which were manufactured under the above-described preferred hot-press conditions using our steel sheets having a C content of 0.21% or more and less than 0.29%, it is found that a desired TS: 1,470 MPa or more and less than 1,770 MPa corresponding to the C content range: 0.21% or more and less than 0.29% is obtained as described above and the decrease in the surface hardness is also small.

TABLE 5

| Steel sheet No. | Composition (mass %) C | Si | Mn | P | S | Al | N | Sb | Others | $Ac_3$ transformation point (° C.) | Type of steel sheet | Thickness (mm) | Remark |
|---|---|---|---|---|---|---|---|---|---|---|---|---|---|
| A | 0.27 | 0.64 | 1.74 | 0.02 | 0.004 | 0.038 | 0.004 | 0.003 | — | 833 | Hot-rolled steel sheet | 2.3 | Within our range |
| B | 0.23 | 0.09 | 2.42 | 0.02 | 0.003 | 0.039 | 0.003 | 0.005 | — | 802 | As cold-rolled steel sheet (Cold rolling reduction: 50%) | 1.6 | Within our range |
| C | 0.23 | 0.16 | 2.68 | 0.02 | 0.004 | 0.044 | 0.004 | 0.010 | — | 802 | As cold-rolled steel sheet (Cold rolling reduction: 50%) | 1.6 | Within our range |
| D | 0.22 | 0.11 | 1.46 | 0.01 | 0.005 | 0.042 | 0.004 | 0.027 | — | 820 | Cold-rolled steel sheet | 1.2 | Within our range |
| E | 0.18 | 0.21 | 1.44 | 0.02 | 0.004 | 0.036 | 0.003 | 0.006 | — | 833 | As cold-rolled steel sheet (Cold rolling reduction: 50%) | 1.6 | Within our range |
| F | 0.31 | 0.28 | 1.37 | 0.02 | 0.003 | 0.039 | 0.003 | 0.005 | — | 811 | As cold-rolled steel sheet (Cold rolling reduction: 50%) | 1.6 | Within our range |
| G | 0.21 | 0.11 | 1.46 | 0.01 | 0.005 | 0.041 | 0.003 | <0.001 | — | 822 | As cold-rolled steel sheet (Cold rolling reduction: 50%) | 1.6 | Out of our range |
| H | 0.26 | 0.23 | 1.77 | 0.01 | 0.004 | 0.040 | 0.004 | 0.004 | Ni: 1.1, Cu: 0.4 | 780 | As cold-rolled steel sheet (Cold rolling reduction: 50%) | 1.6 | Within our range |
| I | 0.24 | 0.20 | 1.42 | 0.02 | 0.003 | 0.042 | 0.005 | 0.006 | Cr: 0.3, Mo: 0.5 | 841 | As cold-rolled steel sheet (Cold rolling reduction: 50%) | 1.6 | Within our range |
| J | 0.25 | 0.25 | 1.43 | 0.01 | 0.004 | 0.039 | 0.003 | 0.007 | Ti: 0.06, Nb: 0.04 | 821 | As cold-rolled steel sheet (Cold rolling reduction: 50%) | 1.6 | Within our range |
| K | 0.28 | 0.20 | 1.62 | 0.01 | 0.005 | 0.037 | 0.004 | 0.016 | V: 0.09, W: 0.05 | 810 | As cold-rolled steel sheet (Cold rolling reduction: 50%) | 1.6 | Within our range |
| L | 0.22 | 0.18 | 1.42 | 0.02 | 0.005 | 0.029 | 0.003 | 0.008 | B: 0.0015 | 824 | As cold-rolled steel sheet (Cold rolling reduction: 50%) | 1.6 | Within our range |
| M | 0.26 | 0.12 | 1.64 | 0.01 | 0.003 | 0.048 | 0.005 | 0.009 | Sc(REM): 0.007 | 809 | As cold-rolled steel sheet (Cold rolling reduction: 50%) | 1.6 | Within our range |
| N | 0.23 | 0.14 | 1.37 | 0.01 | 0.004 | 0.052 | 0.004 | 0.007 | Ca: 0.0022, Mg: 0.0015 | 820 | As cold-rolled steel sheet (Cold rolling reduction: 50%) | 1.6 | Within our range |
| O | 0.23 | 0.19 | 1.39 | 0.02 | 0.006 | 0.037 | 0.005 | 0.006 | — | 823 | As cold-rolled steel sheet (Cold rolling reduction: 63%) | 1.2 | Within our range |
| P | 0.24 | 0.13 | 1.41 | 0.01 | 0.004 | 0.034 | 0.003 | 0.011 | — | 817 | As cold-rolled steel sheet (Cold rolling reduction: 44%) | 1.8 | Within our range |

TABLE 6

| Hot-pressed steel sheet member No. | Steel sheet No. | Hot-press conditions: Heating rate (° C./sec) | Heating temperature (° C.) | Holding time (sec) | Press starting temperature (° C.) | Cooling rate (° C./sec) | TS (MPa) | Hardness: Surface | Hardness: Center of sheet thickness | Area ratio of martensite phase (%) | Remark |
|---|---|---|---|---|---|---|---|---|---|---|---|
| 1 | A | 15 | 950 | 120 | 650 | 60 | 1694 | 495 | 525 | 100 | Example |
| 2 | | 15 | 780 | 120 | 650 | 60 | 1423 | 406 | 443 | 70 | Example |
| 3 | | 15 | 900 | 0 | 650 | 60 | 1451 | 411 | 445 | 85 | Example |
| 4 | B | 15 | 870 | 120 | 650 | 60 | 1516 | 446 | 466 | 100 | Example |
| 5 | C | 15 | 870 | 120 | 650 | 60 | 1584 | 479 | 489 | 100 | Example |
| 6 | | 15 | 870 | 120 | 350 | 60 | 1415 | 428 | 440 | 75 | Example |
| 7 | | 15 | 860 | 120 | 650 | 1 | 1432 | 434 | 445 | 80 | Example |
| 8 | D | 15 | 860 | 120 | 650 | 60 | 1495 | 454 | 464 | 100 | Example |
| 9 | E | 15 | 900 | 120 | 650 | 60 | 1340 | 400 | 418 | 100 | Example |
| 10 | F | 15 | 900 | 120 | 650 | 60 | 1823 | 542 | 562 | 100 | Example |
| 11 | G | 15 | 890 | 120 | 650 | 60 | 1471 | 361 | 451 | 100 | Comparative Example |
| 12 | H | 15 | 840 | 120 | 650 | 60 | 1699 | 498 | 523 | 100 | Example |
| 13 | I | 15 | 900 | 120 | 650 | 60 | 1610 | 481 | 499 | 100 | Example |
| 14 | J | 15 | 880 | 120 | 650 | 60 | 1655 | 496 | 512 | 100 | Example |
| 15 | K | 15 | 890 | 120 | 650 | 60 | 1733 | 526 | 536 | 100 | Example |
| 16 | L | 15 | 900 | 120 | 650 | 60 | 1492 | 449 | 463 | 100 | Example |
| 17 | M | 15 | 900 | 120 | 650 | 60 | 1632 | 499 | 510 | 100 | Example |
| 18 | N | 15 | 880 | 120 | 650 | 60 | 1535 | 457 | 473 | 100 | Example |
| 19 | O | 15 | 900 | 540 | 650 | 60 | 1535 | 456 | 474 | 100 | Example |
| 20 | | 15 | 910 | 120 | 650 | 15 | 1524 | 453 | 473 | 100 | Example |
| 21 | | 2 | 870 | 120 | 650 | 60 | 1560 | 464 | 483 | 100 | Example |
| 22 | P | 15 | 890 | 120 | 650 | 60 | 1642 | 500 | 510 | 100 | Example |

EXAMPLE 4

Hot-pressed steel sheet member Nos. 1 to 9 having a hat shape were prepared by conducting heating, holding, hot pressing, and cooling under the hot-press conditions shown in Table 8 using steel sheet Nos. A to I shown in Table 7. In steel sheet Nos. A to C and E to I, in addition to descaling before rolling, the descaling being performed in the stage of hot-rolling of the manufacturing of the steel sheet, descaling was repeatedly conducted immediately after rolling in a high-temperature range of 1,000° C. or higher, at a rolling reduction of 15% or more, and at a water-stream collision pressure of 5 MPa or more. The number of times of this descaling is shown in Table 7. In steel sheet No. D, the latter descaling was not performed.

The same tests as those in Example 1 were conducted to measure the TS, the Vickers hardness of a surface and a central portion in the thickness direction of the steel sheet, and the area ratio of a martensite phase of each of the hot-pressed steel sheet members. The degree of concentration of Sb was evaluated by a line analysis in terms of Sb-max/Sb-ave using an EPMA equipped with an EDS out of the methods described above. Furthermore, a plurality of fatigue test specimens were prepared from a bottom position of the hat of each of the hot-pressed steel sheet members, and a fatigue test under pulsating tension was conducted. The average of the maximum stress at which a test specimen does not fracture even after a load is repeatedly applied $10^7$ times was defined as a fatigue strength, and a fatigue strength ratio (=fatigue strength/TS) was determined In general, the fatigue strength ratio of a steel sheet having a TS of more than 1,180 MPa and composed of a single martensite phase is about 0.55. Accordingly, in the case where the fatigue strength ratio exceeded 0.58, the specimen was evaluated to have an excellent fatigue property.

Table 8 shows the results. In hot-pressed steel sheet member Nos. 1 to 4 and 6 to 9, as described above, a desired TS: 1,470 MPa or more and less than 1,770 MPa corresponding to the C content range: 0.21% or more and less than 0.29% is obtained and the decrease in the surface hardness is small. In hot-pressed steel sheet member No. 5 having a low Sb content, which is out of our range, a significant decrease in the surface hardness is observed.

The fatigue strength ratio of each of the hot-pressed steel sheet members is equal to or higher than that of the normal material. In particular, hot-pressed steel sheet member Nos. 1, 2, 4, and 6 to 9, which have an Sb content in the range of 0.002% to 0.01%, have a fatigue strength ratio of 0.58 or more, indicating that these members have excellent fatigue properties. In hot-pressed steel sheet member No. 3 composed of steel sheet No. C which had an Sb content of 0.015%, and which was obtained by conducting, in addition to usual descaling before rolling, descaling once immediately after rolling in a high-temperature range of 1,000° C. or higher at a rolling reduction of 15% or more, a fatigue strength ratio substantially the same as that of the normal material was obtained. Furthermore, in hot-pressed steel sheet member Nos. 1, 2, and 7 to 9 composed of steel sheet Nos. A, B, G, H, and I, respecttively, which were obtained by conducting descaling three times immediately after rolling in a high-temperature range of 1,000° C. or higher at a rolling reduction of 15% or more, the ratio Sb-max/Sb-ave was 5 or less and particularly good fatigue strength ratios were obtained.

TABLE 7

| Steel sheet | Composition (mass %) | | | | | | | | | $Ac_3$ transformation point |
|---|---|---|---|---|---|---|---|---|---|---|
| No. | C | Si | Mn | P | S | Al | N | Sb | Others | (° C.) |
| A | 0.21 | 0.64 | 1.16 | 0.02 | 0.004 | 0.038 | 0.004 | 0.003 | Cr: 0.24, Ti: 0.012, B: 0.0010 | 854 |
| B | 0.21 | 0.20 | 1.18 | 0.01 | 0.005 | 0.042 | 0.004 | 0.006 | Ti: 0.015 | 831 |
| C | 0.21 | 0.21 | 1.20 | 0.02 | 0.004 | 0.036 | 0.003 | 0.015 | — | 831 |
| D | 0.22 | 0.28 | 1.20 | 0.02 | 0.003 | 0.039 | 0.003 | 0.005 | B: 0.0024 | 833 |
| E | 0.22 | 0.11 | 1.37 | 0.01 | 0.005 | 0.041 | 0.003 | <0.001 | — | 821 |
| F | 0.22 | 0.23 | 1.45 | 0.01 | 0.004 | 0.040 | 0.004 | 0.004 | Cr: 0.22, Ti: 0.025 | 826 |
| G | 0.23 | 0.20 | 1.42 | 0.02 | 0.003 | 0.042 | 0.005 | 0.006 | Mo: 0.5 | 843 |
| H | 0.25 | 0.20 | 1.27 | 0.01 | 0.005 | 0.037 | 0.004 | 0.009 | Ni: 0.02, Nb: 0.02 | 821 |
| I | 0.28 | 0.35 | 0.85 | 0.01 | 0.004 | 0.052 | 0.004 | 0.007 | — | 829 |

| Steel sheet No. | Descaling condition in hot rolling (The number of times) | Type of steel sheet | Thickness (mm) | Remark |
|---|---|---|---|---|
| A | 3 | Hot-rolled steel sheet | 2.3 | Within our range |
| B | 3 | Cold-rolled steel sheet | 1.2 | Within our range |
| C | 1 | As cold-rolled steel sheet (Cold rolling reduction: 50%) | 1.6 | Within our range |
| D | 0 | As cold-rolled steel sheet (Cold rolling reduction: 50%) | 1.6 | Within our range |
| E | 1 | As cold-rolled steel sheet (Cold rolling reduction: 50%) | 1.6 | Out of our range |
| F | 2 | As cold-rolled steel sheet (Cold rolling reduction: 50%) | 1.6 | Within our range |
| G | 3 | As cold-rolled steel sheet (Cold rolling reduction: 50%) | 1.6 | Within our range |
| H | 3 | Cold-rolled steel sheet | 1.6 | Within our range |
| I | 3 | Hot-rolled steel sheet | 3.2 | Within our range |

TABLE 8

| Hot-pressed steel sheet member No. | Steel sheet No. | Hot-press conditions: Heating rate (° C./sec) | Heating temperature (° C.) | Holding time (sec) | Press starting temperature (° C.) | Cooling rate (° C./sec) | TS (MPa) | Hardness: Surface | Center of sheet thickness | Area ratio of martensite phase (%) | Sb-max/Sb-ave | Fatigue strength ratio | Remark |
|---|---|---|---|---|---|---|---|---|---|---|---|---|---|
| 1 | A | 15 | 950 | 120 | 650 | 60 | 1477 | 439 | 452 | 100 | 4.1 | 0.60 | Example |
| 2 | B | 15 | 870 | 120 | 700 | 60 | 1481 | 436 | 451 | 100 | 3.4 | 0.61 | Example |
| 3 | C | 15 | 870 | 120 | 650 | 50 | 1477 | 434 | 452 | 100 | 5.9 | 0.56 | Example |
| 4 | D | 15 | 860 | 150 | 650 | 65 | 1571 | 471 | 481 | 100 | 15.9 | 0.58 | Example |
| 5 | E | 15 | 860 | 150 | 650 | 65 | 1519 | 394 | 465 | 100 | — | 0.53 | Comparative Example |
| 6 | F | 15 | 860 | 150 | 650 | 65 | 1523 | 457 | 467 | 100 | 6.4 | 0.59 | Example |
| 7 | G | 15 | 890 | 120 | 650 | 60 | 1558 | 470 | 477 | 100 | 3.4 | 0.61 | Example |
| 8 | H | 15 | 840 | 180 | 650 | 55 | 1584 | 470 | 485 | 100 | 3.0 | 0.62 | Example |
| 9 | I | 15 | 900 | 120 | 750 | 60 | 1707 | 520 | 523 | 100 | 3.3 | 0.62 | Example |

EXAMPLE 5

Hot-pressed steel sheet member Nos. 1 to 22 having a hat shape were prepared by conducting heating, holding, hot pressing, and cooling under the hot-press conditions shown in Table 10 using steel sheet Nos. A to P shown in Table 9.

The same tests as those in Example 1 were conducted to measure the TS, the Vickers hardness of a surface and a central portion in the thickness direction of the steel sheet, and the area ratio of a martensite phase of each of the hot-pressed steel sheet members.

Table 10 shows the results. Hot-pressed steel sheet member No. 11 has an Sb content lower than the lower limit of our range and the decrease in the surface hardness of this hot-pressed steel sheet member is more significant than that of hot-pressed steel sheet member No. 4 which had substantially the same composition and was manufactured under substantially the same manufacturing conditions. Hot-pressed steel sheet members other than the above are examples of our steel sheet members. It is found that these hot-pressed steel sheet members each have a TS in the range of 980 to 2,130 MPa, and the decrease in the surface hardness is also small. In particular, in hot-pressed steel sheet member Nos. 1, 4, 5, 8, and 12 to 22, which were manufactured under the above-described preferred hot-press conditions using our steel sheets having a C content of 0.14% or more and less than 0.21%, it is found that a desired TS: 1,180 MPa or more and less than 1,470 MPa corresponding to the C content range: 0.14% or more and less than 0.21% is obtained as described above and the decrease in the surface hardness is also small.

TABLE 9

| Steel sheet No. | Composition (mass %): C | Si | Mn | P | S | Al | N | Sb | Others | $Ac_3$ transformation point (° C.) | Type of steel sheet | Thickness (mm) | Remark |
|---|---|---|---|---|---|---|---|---|---|---|---|---|---|
| A | 0.19 | 0.86 | 1.54 | 0.01 | 0.004 | 0.046 | 0.004 | 0.004 | — | 864 | Hot-rolled steel sheet | 2.3 | Within our range |
| B | 0.16 | 0.11 | 2.46 | 0.03 | 0.003 | 0.035 | 0.004 | 0.004 | — | 817 | As cold-rolled steel sheet (Cold rolling reduction: 50%) | 1.6 | Within our range |
| C | 0.15 | 0.12 | 2.58 | 0.02 | 0.003 | 0.039 | 0.004 | 0.010 | — | 818 | As cold-rolled steel sheet (Cold rolling reduction: 50%) | 1.6 | Within our range |
| D | 0.15 | 0.22 | 1.44 | 0.02 | 0.005 | 0.037 | 0.005 | 0.026 | — | 840 | Cold-rolled steel sheet | 1.2 | Within our range |
| E | 0.12 | 0.30 | 1.49 | 0.02 | 0.006 | 0.036 | 0.003 | 0.004 | — | 850 | As cold-rolled steel sheet (Cold rolling reduction: 50%) | 1.6 | Within our range |
| F | 0.22 | 0.19 | 1.26 | 0.01 | 0.007 | 0.042 | 0.004 | 0.005 | — | 827 | As cold-rolled steel sheet (Cold rolling reduction: 50%) | 1.6 | Within our range |
| G | 0.15 | 0.11 | 1.57 | 0.01 | 0.005 | 0.046 | 0.005 | <0.001 | — | 832 | As cold-rolled steel sheet (Cold rolling reduction: 50%) | 1.6 | Out of our range |
| H | 0.14 | 0.25 | 1.94 | 0.02 | 0.005 | 0.045 | 0.003 | 0.006 | Ni: 1.3, Cu: 0.5 | 797 | As cold-rolled steel sheet (Cold rolling reduction: 50%) | 1.6 | Within our range |
| I | 0.18 | 0.18 | 1.54 | 0.02 | 0.003 | 0.041 | 0.004 | 0.004 | Cr: 0.6, Mo: 0.5 | 850 | As cold-rolled steel sheet (Cold rolling reduction: 50%) | 1.6 | Within our range |
| J | 0.17 | 0.19 | 1.82 | 0.01 | 0.003 | 0.038 | 0.005 | 0.006 | Ti: 0.05, Nb: 0.04 | 829 | As cold-rolled steel sheet (Cold rolling reduction: 50%) | 1.6 | Within our range |
| K | 0.16 | 0.21 | 1.73 | 0.02 | 0.003 | 0.037 | 0.003 | 0.014 | V: 0.06, W: 0.04 | 833 | As cold-rolled steel sheet (Cold rolling reduction: 50%) | 1.6 | Within our range |
| L | 0.17 | 0.16 | 1.24 | 0.01 | 0.004 | 0.039 | 0.005 | 0.006 | B: 0.0014 | 836 | As cold-rolled steel sheet (Cold rolling reduction: 50%) | 1.6 | Within our range |
| M | 0.14 | 0.11 | 1.56 | 0.02 | 0.005 | 0.044 | 0.005 | 0.010 | Sc(REM): 0.005 | 835 | As cold-rolled steel sheet (Cold rolling reduction: 50%) | 1.6 | Within our range |
| N | 0.15 | 0.18 | 1.47 | 0.01 | 0.006 | 0.049 | 0.004 | 0.005 | Ca: 0.0018, Mg: 0.0015 | 838 | As cold-rolled steel sheet (Cold rolling reduction: 50%) | 1.6 | Within our range |
| O | 0.20 | 0.21 | 1.76 | 0.01 | 0.007 | 0.041 | 0.004 | 0.009 | — | 825 | As cold-rolled steel sheet (Cold rolling reduction: 63%) | 1.2 | Within our range |
| P | 0.16 | 0.20 | 1.35 | 0.01 | 0.006 | 0.051 | 0.005 | 0.011 | — | 838 | As cold-rolled steel sheet (Cold rolling reduction: 44%) | 1.8 | Within our range |

TABLE 10

| Hot-pressed steel sheet member No. | Steel sheet No. | Hot-press conditions: Heating rate (° C./sec) | Heating temperature (° C.) | Holding time (sec) | Press starting temperature (° C.) | Cooling rate (° C./sec) | TS (MPa) | Hardness: Surface | Hardness: Center of sheet thickness | Area ratio of martensite phase (%) | Remark |
|---|---|---|---|---|---|---|---|---|---|---|---|
| 1 | A | 15 | 940 | 120 | 650 | 60 | 1442 | 428 | 448 | 100 | Example |
| 2 | | 15 | 800 | 120 | 650 | 60 | 1132 | 327 | 354 | 80 | Example |
| 3 | | 15 | 900 | 0 | 650 | 60 | 1151 | 329 | 353 | 80 | Example |
| 4 | B | 15 | 850 | 120 | 650 | 60 | 1249 | 365 | 385 | 100 | Example |
| 5 | C | 15 | 870 | 120 | 650 | 60 | 1267 | 388 | 396 | 100 | Example |
| 6 | | 15 | 860 | 120 | 350 | 60 | 1144 | 345 | 355 | 75 | Example |
| 7 | | 15 | 870 | 120 | 650 | 1 | 1131 | 345 | 354 | 85 | Example |
| 8 | D | 15 | 920 | 120 | 650 | 60 | 1206 | 363 | 371 | 100 | Example |
| 9 | E | 15 | 900 | 120 | 650 | 60 | 1137 | 333 | 353 | 100 | Example |
| 10 | F | 15 | 900 | 120 | 650 | 60 | 1504 | 452 | 468 | 100 | Example |
| 11 | G | 15 | 900 | 120 | 650 | 60 | 1189 | 285 | 357 | 100 | Comparative Example |
| 12 | H | 15 | 850 | 120 | 650 | 60 | 1198 | 357 | 372 | 100 | Example |
| 13 | I | 15 | 910 | 120 | 650 | 60 | 1424 | 424 | 444 | 100 | Example |
| 14 | J | 15 | 900 | 120 | 650 | 60 | 1380 | 415 | 430 | 100 | Example |
| 15 | K | 15 | 900 | 120 | 650 | 60 | 1224 | 368 | 376 | 100 | Example |
| 16 | L | 15 | 900 | 120 | 650 | 60 | 1346 | 405 | 420 | 100 | Example |
| 17 | M | 15 | 900 | 120 | 650 | 60 | 1185 | 360 | 368 | 100 | Example |
| 18 | N | 15 | 880 | 120 | 650 | 60 | 1265 | 377 | 393 | 100 | Example |
| 19 | O | 15 | 880 | 540 | 650 | 60 | 1441 | 438 | 447 | 100 | Example |
| 20 | | 15 | 890 | 120 | 650 | 15 | 1402 | 424 | 435 | 100 | Example |
| 21 | | 2 | 880 | 120 | 650 | 60 | 1464 | 433 | 443 | 100 | Example |
| 22 | P | 15 | 890 | 120 | 650 | 60 | 1269 | 387 | 395 | 100 | Example |

EXAMPLE 6

Hot-pressed steel sheet member Nos. 1 to 8 having a hat shape were prepared by conducting heating, holding, hot pressing, and cooling under the hot-press conditions shown in Table 12 using steel sheet Nos. A to H shown in Table 11. In each of the steel sheets, in addition to descaling before rolling, the descaling being performed in the stage of hot-rolling of the manufacturing of the steel sheet, descaling was repeatedly conducted immediately after rolling in a high-temperature range of 1,000° C. or higher, at a rolling reduction of 15% or more, and at a water-stream collision pressure of 5 MPa or more. The number of times of this descaling is shown in Table 11.

The same tests as those in Example 1 were conducted to measure the TS, the Vickers hardness of a surface and a central portion in the thickness direction of the steel sheet, and the area ratio of a martensite phase of each of the hot-pressed steel sheet members. The ratio Sb-max/Sb-ave and the fatigue strength ratio were also determined as in Example 4.

Table 12 shows the results. In hot-pressed steel sheet member Nos. 1 to 3 and 5 to 8, as described above, a desired TS: 1,180 MPa or more and less than 1,470 MPa corresponding to the C content range: 0.14% or more and less than 0.21% is obtained and the decrease in the surface hardness is small. In hot-pressed steel sheet member No. 4 having a low Sb content, which is out of our range, a significant decrease in the surface hardness is observed.

The fatigue strength ratio of each of the hot-pressed steel sheet members is equal to or higher than that of the normal material. In particular, hot-pressed steel sheet member Nos. 1 to 3 and 5 to 7, which have an Sb content in the range of 0.002% to 0.01%, have a fatigue strength ratio of 0.58 or more, indicating that these members have excellent fatigue properties. In hot-pressed steel sheet member No. 8 composed of steel sheet No. H which had an Sb content of 0.021%, and which was obtained by conducting, in addition to usual descaling before rolling, descaling once immediately after rolling in a high-temperature range of 1,000° C. or higher at a rolling reduction of 15% or more, a fatigue strength ratio substantially the same as that of the normal material was obtained. Furthermore, in hot-pressed steel sheet member Nos. 1, 3, and 7 composed of steel sheet Nos. A, C, and G, respectively, which were obtained by conducting descaling three times immediately after rolling in a high-temperature range of 1,000° C. or higher at a rolling reduction of 15% or more, the ratio Sb-max/Sb-ave was 5 or less and particularly good fatigue strength ratios were obtained.

TABLE 11

| Steel sheet No. | Composition (mass %): C | Si | Mn | P | S | Al | N | Sb | Others | $Ac_3$ transformation point (° C.) |
|---|---|---|---|---|---|---|---|---|---|---|
| A | 0.14 | 0.64 | 1.74 | 0.02 | 0.004 | 0.038 | 0.004 | 0.008 | — | 860 |
| B | 0.15 | 0.20 | 0.96 | 0.01 | 0.005 | 0.042 | 0.004 | 0.003 | Cr: 0.22, Ti: 0.015 | 846 |
| C | 0.18 | 0.28 | 1.20 | 0.02 | 0.003 | 0.039 | 0.003 | 0.005 | B: 0.0024 | 841 |
| D | 0.18 | 0.11 | 1.37 | 0.01 | 0.005 | 0.041 | 0.003 | <0.001 | — | 829 |
| E | 0.19 | 0.23 | 1.45 | 0.01 | 0.004 | 0.040 | 0.004 | 0.004 | Cr: 0.22, Ti: 0.025 | 832 |

TABLE 11-continued

| | | | | | | | | | | |
|---|---|---|---|---|---|---|---|---|---|---|
| F | 0.20 | 0.20 | 1.27 | 0.01 | 0.005 | 0.037 | 0.004 | 0.009 | Ni: 0.02, Nb: 0.02 | 831 |
| G | 0.20 | 0.35 | 0.85 | 0.01 | 0.004 | 0.052 | 0.004 | 0.007 | Cr: 0.18, B: 0.0015 | 845 |
| H | 0.20 | 0.13 | 1.34 | 0.01 | 0.004 | 0.034 | 0.003 | 0.021 | — | 827 |

| Steel sheet No. | Descaling condition in hot rolling (The number of times) | Type of steel sheet | Thickness (mm) | Remark |
|---|---|---|---|---|
| A | 3 | Hot-rolled steel sheet | 2.3 | Within our range |
| B | 2 | Cold-rolled steel sheet | 1.2 | Within our range |
| C | 3 | As cold-rolled steel sheet (Cold rolling reduction: 50%) | 1.6 | Within our range |
| D | 3 | As cold-rolled steel sheet (Cold rolling reduction: 50%) | 1.6 | Out of our range |
| E | 2 | As cold-rolled steel sheet (Cold rolling reduction: 50%) | 1.6 | Within our range |
| F | 1 | Cold-rolled steel sheet | 1.6 | Within our range |
| G | 3 | Hot-rolled steel sheet | 2.3 | Within our range |
| H | 1 | Cold-rolled steel sheet | 2.0 | Within our range |

TABLE 12

| | | Hot-press conditions | | | | | | Hardness | | Area | | | |
|---|---|---|---|---|---|---|---|---|---|---|---|---|---|
| Hot-pressed steel sheet member No. | Steel sheet No. | Heating rate (° C./sec) | Heating temperature (° C.) | Holding time (sec) | Press starting temperature (° C.) | Cooling rate (° C./sec) | TS (MPa) | Surface | Center of sheet thickness | ratio of martensite phase (%) | Sb-max/Sb-ave | Fatigue strength ratio | Remark |
| 1 | A | 15 | 910 | 60 | 650 | 40 | 1188 | 349 | 362 | 100 | 3.2 | 0.62 | Example |
| 2 | B | 15 | 870 | 120 | 800 | 120 | 1229 | 365 | 375 | 100 | 7.1 | 0.61 | Example |
| 3 | C | 15 | 870 | 120 | 650 | 50 | 1353 | 406 | 414 | 100 | 3.5 | 0.62 | Example |
| 4 | D | 15 | 880 | 90 | 650 | 65 | 1360 | 345 | 417 | 100 | — | 0.53 | Comparative Example |
| 5 | E | 15 | 880 | 90 | 650 | 65 | 1394 | 421 | 427 | 100 | 6.3 | 0.61 | Example |
| 6 | F | 15 | 860 | 150 | 650 | 65 | 1435 | 432 | 439 | 100 | 7.3 | 0.60 | Example |
| 7 | G | 15 | 890 | 120 | 650 | 80 | 1413 | 419 | 433 | 100 | 3.2 | 0.64 | Example |
| 8 | H | 15 | 840 | 180 | 650 | 55 | 1441 | 437 | 439 | 100 | 5.2 | 0.54 | Example |

EXAMPLE 7

Hot-pressed steel sheet member Nos. 1 to 22 having a hat shape were prepared by conducting heating, holding, hot pressing, and cooling under the hot-press conditions shown in Table 14 using steel sheet Nos. A to P shown in Table 13.

The same tests as those in Example 1 were conducted to measure the TS, the Vickers hardness of a surface and a central portion in the thickness direction of the steel sheet, and the area ratio of a martensite phase of each of the hot-pressed steel sheet members.

Table 14 shows the results. In hot-pressed steel sheet member Nos. 2, 3, 6, 7, and 9, the TS does not reach the target of 980 MPa. Hot-pressed steel sheet member No. 11 has an Sb content lower than the lower limit of our range, and the decrease in the surface hardness of this steel sheet member is more significant than that of hot-pressed steel sheet member No. 4 which had substantially the same composition and was manufactured under substantially the same manufacturing conditions. Hot-pressed steel sheet members other than the above are examples of our steel sheet members. It is found that these hot-pressed steel sheet members each have a TS in the range of 980 to 2,130 MPa, and the decrease in the surface hardness is also small. In particular, in hot-pressed steel sheet member Nos. 1, 4, 5, 8, and 12 to 22, which were manufactured under the above-described preferred hot-press conditions using our steel sheets having a C content of 0.09% or more and less than 0.14%, it is found that a desired TS: 980 MPa or more and less than 1,180 MPa corresponding to the C content range: 0.09% or more and less than 0.14% is obtained as described above and the decrease in the surface hardness is also small.

TABLE 13

| Steel sheet | Composition (mass %) | | | | | | | | | $Ac_3$ transformation point | Type of | Thickness | |
|---|---|---|---|---|---|---|---|---|---|---|---|---|---|
| No. | C | Si | Mn | P | S | Al | N | Sb | Others | (° C.) | steel sheet | (mm) | Remark |
| A | 0.13 | 0.97 | 1.62 | 0.02 | 0.005 | 0.043 | 0.005 | 0.003 | — | 881 | Hot-rolled steel sheet | 2.3 | Within our range |
| B | 0.10 | 0.10 | 2.53 | 0.01 | 0.004 | 0.045 | 0.004 | 0.005 | — | 828 | As cold-rolled steel sheet (Cold rolling reduction: 50%) | 1.6 | Within our range |
| C | 0.10 | 0.14 | 2.51 | 0.01 | 0.003 | 0.041 | 0.005 | 0.011 | — | 830 | As cold-rolled steel sheet (Cold rolling reduction: 50%) | 1.6 | Within our range |

TABLE 13-continued

| Steel sheet No. | Composition (mass %) C | Si | Mn | P | S | Al | N | Sb | Others | $Ac_3$ transformation point (° C.) | Type of steel sheet | Thickness (mm) | Remark |
|---|---|---|---|---|---|---|---|---|---|---|---|---|---|
| D | 0.09 | 0.17 | 1.32 | 0.02 | 0.006 | 0.038 | 0.004 | 0.026 | — | 852 | Cold-rolled steel sheet | 1.2 | Within our range |
| E | 0.07 | 0.23 | 1.58 | 0.01 | 0.007 | 0.033 | 0.004 | 0.005 | — | 855 | As cold-rolled steel sheet (Cold rolling reduction: 50%) | 1.6 | Out of our range |
| F | 0.15 | 0.22 | 1.33 | 0.01 | 0.006 | 0.040 | 0.003 | 0.004 | — | 842 | As cold-rolled steel sheet (Cold rolling reduction: 50%) | 1.6 | Within our range |
| G | 0.09 | 0.13 | 1.42 | 0.02 | 0.006 | 0.046 | 0.004 | <0.001 | — | 848 | As cold-rolled steel sheet (Cold rolling reduction: 50%) | 1.6 | Out of our range |
| H | 0.11 | 0.22 | 1.71 | 0.01 | 0.006 | 0.039 | 0.003 | 0.005 | Ni: 1.4, Cu: 0.3 | 808 | As cold-rolled steel sheet (Cold rolling reduction: 50%) | 1.6 | Within our range |
| I | 0.12 | 0.21 | 1.45 | 0.01 | 0.005 | 0.036 | 0.005 | 0.005 | Cr: 0.4, Mo: 0.4 | 862 | As cold-rolled steel sheet (Cold rolling reduction: 50%) | 1.6 | Within our range |
| J | 0.11 | 0.21 | 1.42 | 0.02 | 0.003 | 0.037 | 0.004 | 0.006 | Ti: 0.05, Nb: 0.03 | 848 | As cold-rolled steel sheet (Cold rolling reduction: 50%) | 1.6 | Within our range |
| K | 0.10 | 0.23 | 1.55 | 0.02 | 0.004 | 0.028 | 0.004 | 0.013 | V: 0.07, W: 0.03 | 849 | As cold-rolled steel sheet (Cold rolling reduction: 50%) | 1.6 | Within our range |
| L | 0.10 | 0.15 | 1.31 | 0.01 | 0.006 | 0.039 | 0.004 | 0.005 | B: 0.0013 | 849 | As cold-rolled steel sheet (Cold rolling reduction: 50%) | 1.6 | Within our range |
| M | 0.11 | 0.13 | 1.65 | 0.01 | 0.004 | 0.040 | 0.005 | 0.010 | Sc(REM): 0.006 | 840 | As cold-rolled steel sheet (Cold rolling reduction: 50%) | 1.6 | Within our range |
| N | 0.12 | 0.16 | 1.39 | 0.02 | 0.007 | 0.051 | 0.003 | 0.004 | Ca: 0.0020, Mg: 0.0011 | 844 | As cold-rolled steel sheet (Cold rolling reduction: 50%) | 1.6 | Within our range |
| O | 0.10 | 0.20 | 1.47 | 0.01 | 0.006 | 0.042 | 0.005 | 0.008 | — | 849 | As cold-rolled steel sheet (Cold rolling reduction: 63%) | 1.2 | Within our range |
| P | 0.10 | 0.19 | 1.43 | 0.02 | 0.005 | 0.044 | 0.004 | 0.012 | — | 849 | As cold-rolled steel sheet (Cold rolling reduction: 44%) | 1.8 | Within our range |

TABLE 14

| Hot-pressed steel sheet member No. | Steel sheet No. | Hot-press conditions: Heating rate (° C./sec) | Heating temperature (° C.) | Holding time (sec) | Press starting temperature (° C.) | Cooling rate (° C./sec) | TS (MPa) | Hardness: Surface | Hardness: Center of sheet thickness | Area ratio of martensite phase (%) | Remark |
|---|---|---|---|---|---|---|---|---|---|---|---|
| 1 | A | 15 | 950 | 120 | 650 | 60 | 1153 | 340 | 358 | 100 | Example |
| 2 | | 15 | 800 | 120 | 650 | 60 | 932 | 264 | 289 | 75 | Comparative Example |
| 3 | | 15 | 900 | 0 | 650 | 60 | 948 | 273 | 294 | 85 | Comparative Example |
| 4 | B | 15 | 850 | 120 | 650 | 60 | 1017 | 306 | 318 | 100 | Example |
| 5 | C | 15 | 860 | 120 | 650 | 60 | 1030 | 316 | 322 | 100 | Example |
| 6 | | 15 | 860 | 120 | 350 | 60 | 958 | 292 | 300 | 70 | Comparative Example |
| 7 | | 15 | 860 | 120 | 650 | 1 | 966 | 292 | 299 | 85 | Comparative Example |
| 8 | D | 15 | 860 | 120 | 650 | 60 | 984 | 298 | 304 | 100 | Example |
| 9 | E | 15 | 900 | 120 | 650 | 60 | 913 | 270 | 282 | 100 | Comparative Example |
| 10 | F | 15 | 900 | 120 | 650 | 60 | 1218 | 364 | 379 | 100 | Example |
| 11 | G | 15 | 900 | 120 | 650 | 60 | 986 | 247 | 301 | 100 | Comparative Example |
| 12 | H | 15 | 850 | 120 | 650 | 60 | 1070 | 322 | 334 | 100 | Example |
| 13 | I | 15 | 880 | 120 | 650 | 60 | 1111 | 330 | 342 | 100 | Example |
| 14 | J | 15 | 880 | 120 | 650 | 60 | 1055 | 315 | 325 | 100 | Example |
| 15 | K | 15 | 880 | 120 | 650 | 60 | 1031 | 312 | 318 | 100 | Example |
| 16 | L | 15 | 880 | 120 | 650 | 60 | 1016 | 300 | 312 | 100 | Example |
| 17 | M | 15 | 880 | 120 | 650 | 60 | 1084 | 327 | 333 | 100 | Example |
| 18 | N | 15 | 880 | 120 | 650 | 60 | 1122 | 329 | 344 | 100 | Example |
| 19 | O | 15 | 900 | 540 | 650 | 60 | 1015 | 310 | 317 | 100 | Example |
| 20 | | 15 | 880 | 120 | 650 | 15 | 1003 | 309 | 314 | 100 | Example |
| 21 | | 2 | 860 | 120 | 650 | 60 | 1028 | 312 | 318 | 100 | Example |
| 22 | P | 15 | 900 | 120 | 650 | 60 | 1012 | 307 | 313 | 100 | Example |

The invention claimed is:

1. A hot-pressed steel sheet member having a composition comprising, by mass, C: 0.09% to 0.38%, Si: 0.05% to 2.0%, Mn: 0.5% to 3.0%, P: 0.05% or less, S: 0.05% or less, Al: 0.005% to 0.1%, N: 0.01% or less, Sb: 0.002% to 0.03%, and the balance being Fe and inevitable impurities, and having a tensile strength TS of 980 to 2,130 MPa wherein a ratio of Sb-max/Sb-ave is 5 or less.

2. The hot-pressed steel sheet member according to claim 1, further comprising, by mass, at least one selected from the group consisting of Ni: 0.01% to 5.0%, Cu: 0.01% to 5.0%, Cr: 0.01% to 5.0%, and Mo: 0.01% to 3.0%.

3. The hot-pressed steel sheet member according to claim 1, further comprising, by mass, at least one selected from the group consisting of Ti: 0.005% to 3.0%, Nb: 0.005% to 3.0%, V: 0.005% to 3.0%, and W: 0.005% to 3.0%.

4. The hot-pressed steel sheet member according to claim 1, further comprising, by mass, B: 0.0005% to 0.05%.

5. The hot-pressed steel sheet member according to claim 1, further comprising, by mass, at least one selected from the group consisting of REM: 0.0005% to 0.01%, Ca: 0.0005% to 0.01%, and Mg: 0.0005% to 0.01%.

6. The hot-pressed steel sheet member according to claim 1, comprising carbon in an amount of 0.34% to 0.38% by mass.

7. The hot-pressed steel sheet member according to claim 1, comprising carbon in an amount of 0.29% or more and less than 0.34% by mass.

8. The hot-pressed steel sheet member according to claim 1, comprising carbon in an amount of 0.21% or more and less than 0.29% by mass.

9. The hot-pressed steel sheet member according to claim 1, comprising carbon in an amount of 0.14% or more and less than 0.21% by mass.

10. The hot-pressed steel sheet member according to claim 1, comprising carbon in an amount of 0.09% or more and less than 0.14% by mass.

11. The hot-pressed steel sheet member according to claim 8 or 9, comprising antimony in an amount of 0.002% to 0.01% by mass.

12. A steel sheet for hot-press comprising the composition according to claim 6.

13. A method for manufacturing a hot-pressed steel sheet member comprising:

heating the steel sheet according to claim 12 at a heating rate of 1° C./sec or more;

holding the steel sheet in a temperature range of an $Ac_3$ transformation point to ($Ac_3$ transformation point+150° C.) for 1 to 600 seconds, hot pressing in a temperature range of 550° C. or higher; and conducting cooling at an average cooling rate of 3° C./sec or more down to 200° C.

14. The method according to claim 13, wherein, after the hot pressing, a member is taken out from a metal mold and cooled with a liquid or gas.

15. The hot-pressed steel sheet member according to claim 2, further comprising, by mass, at least one selected from the group consisting of Ti: 0.005% to 3.0%, Nb: 0.005% to 3.0%, V: 0.005% to 3.0%, and W: 0.005% to 3.0%.

16. The hot-pressed steel sheet member according to claim 2, further comprising, by mass, B: 0.0005% to 0.05%.

17. The hot-pressed steel sheet member according to claim 3, further comprising, by mass, B: 0.0005% to 0.05%.

18. The hot-pressed steel sheet member according to claim 2, further comprising, by mass, at least one selected from the group consisting of REM: 0.0005% to 0.01%, Ca: 0.0005% to 0.01%, and Mg: 0.0005% to 0.01%.

19. The hot-pressed steel sheet member according to claim 3, further comprising, by mass, at least one selected from the group consisting of REM: 0.0005% to 0.01%, Ca: 0.0005% to 0.01%, and Mg: 0.0005% to 0.01%.

20. The hot-pressed steel sheet member according to claim 4, further comprising, by mass, at least one selected from the group consisting of REM: 0.0005% to 0.01%, Ca: 0.0005% to 0.01%, and Mg: 0.0005% to 0.01%.

* * * * *